US005795197A

United States Patent [19]

Tsuji et al.

[11] Patent Number: 5,795,197

[45] Date of Patent: Aug. 18, 1998

[54] METALLIC MALE TERMINAL

[75] Inventors: Masanori Tsuji; Motohisa Kashiyama, both of Shizuoka-ken, Japan

[73] Assignee: Yazaki Corporation, Tokyo, Japan

[21] Appl. No.: 747,816

[22] Filed: Nov. 13, 1996

[30] Foreign Application Priority Data

Nov. 17, 1995 [JP] Japan ..... 7-300013

[51] Int. Cl.[6] ..... H01R 9/24

[52] U.S. Cl. ..... 439/884; 439/877

[58] Field of Search ..... 439/884, 877

[56] References Cited

FOREIGN PATENT DOCUMENTS 3-116572 12/1991 Japan .

*Primary Examiner*—Gary F. Paumen

*Attorney, Agent, or Firm*—Finnegan, Henderson, Farabow, Garrett & Dunner, L.L.P.

[57] ABSTRACT

A mating contact portion is formed by folding a plate member into a tongue-like configuration matable with a metallic female terminal, including a contact part in which the plate member is folded in a longitudinal direction along a bending part disposed at a tip of the mating contact portion.

3 Claims, 3 Drawing Sheets

METALLIC MALE TERMINAL

BACKGROUND OF THE INVENTION

1. Field of the Invention

The present invention generally relates to a metallic male terminal, and in particular, to a metallic male terminal of the type in which a plate member is folded (i.e. bent to be doubled by laying one part of it on the other part) to form a tongue-like mating contact portion as a male contact that mates with a metallic female terminal.

2. Description of the Related Art

A conventional metallic male terminal of such the type has been disclosed in Japanese Utility Model Application Laid-Open Publication No. 3-116572.

The conventional male terminal includes a terminal portion for termination of an electrical wiring and a male contact portion integral with the terminal portion.

The male contact portion is formed in a tongue-like configuration matable with a metallic female terminal, by folding a shaped plate member in a transverse direction of the male terminal, i.e. widthwise of the contact portion.

As the plate member is transversely folded, the conventional male terminal has undesirable burrs and edges left on a tip thereof, as they are formed in a press-shaping process.

In application to a connector, the male terminal with such burrs and edges is inserted to be set in a male terminal accommodation chamber of a female-type housing of the connector. In the insertion, the tip of the male contact portion tends to scratch a guiding inside of the accommodation chamber, giving flaws or injuries thereto. In the case of a water-proof connector, an injured sealing may cause a degraded water-proofness.

For a coupling of the connector, the male contact portion of the terminal set in the female-type housing is engaged with a male contact insertion hole at a front end of a male-type housing of the connector. Then, the male-type housing is inserted to the female-type housing, causing the contact portion of the male terminal to mate with a contact portion of a metallic female terminal set in the male-type housing.

In the coupling of the connector, burrs and edges on the tip of the male contact portion tend to be caught by or bound to a tapered guiding surface of the male contact insertion hole, thus constituting an obstruction to the coupling, resulting in a probable use of undue forces that may give damages to the male terminal and the female-type housing.

SUMMARY OF THE INVENTION

It therefore is an object of the present invention to provide a metallic male terminal with a mating contact portion free of undesirable burrs or edges on a tip thereof.

To achieve the object, the present invention provides a metallic male terminal comprising a connecting portion connected with a wire and a mating contact portion integral therewith, the mating contact portion being formed by folding a plate member into a tongue-like configuration matable with a metallic female terminal, the mating contact portion including a first contact part in which the plate member is folded in a longitudinal direction of the metallic male terminal along a bending part disposed at a tip of the mating contact portion.

According to the invention described above, a mating contact portion includes a first contact part formed in a double-plate structure by a folding along a bending part disposed at a tip of the contact portion, permitting the tip to be a fold with a round outside free of burrs or edges.

Therefore, in a setting to a housing of a connector, the mating contact portion is insertable into a male terminal accommodation chamber of the housing, without giving flaws or injuries to an inside of the chamber.

Moreover, in a coupling of the connector, the tip of the mating contact portion is insertable through a male contact insertion hole of a counter housing of the connector from an engaging position to a mating position, without an undue binding by a tapered guiding surface of the insertion hole, permitting the connector housings to be smoothly coupled with each other without damages thereto.

According to another aspect of the invention, the mating contact portion comprises the first contact part disposed at a tip end thereof and a second contact part disposed at base end thereof, the second contact part being formed by folding the plate member in a transverse direction of the metallic male terminal so that a pair of transversely opposing sides of the plate member abut on each other in a transversely central region of the mating contact portion, the second contact part being longer than the first contact part.

Therefore, according to the present invention, a mating contact portion of a metallic male terminal includes a second contact part formed to be longer than a first contact part, by transversely folding a plate member so that the second contact part has a pair of folds located either on both transverse sides thereof, thus permitting the mating contact portion to have an increased buckling strength in a longitudinal direction.

According to still another aspect of the present invention, the mating contact portion has an engagement means for effecting an inter-engagement between the first and second contact parts to prevent a longitudinally folded part of the plate member from slipping in a crossing direction to the longitudinal direction of the metallic male terminal.

Therefore, according to the present invention, a first contact part of a mating contact portion of a metallic male terminal includes a longitudinally folded part of a plate member, which folded part is prevented by an engagement with a second contact part from slipping in a crossing direction to a longitudinal direction of the male terminal.

According to still another aspect of the present invention, the mating contact portion has an engagement means for effecting an intra-engagement in the first contact part to prevent a longitudinally folded part of the plate member from slipping in a crossing direction to the longitudinal direction of the metallic male terminal.

Therefore, according to the present invention, a first contact part of a mating contact portion of a metallic male terminal is composed of a pair of parts of a longitudinally folded plate member, of which either is put on the other and prevented by a mutual engagement therebetween from slipping in a crossing direction to a longitudinal direction of the male terminal.

BRIEF DESCRIPTION OF THE DRAWINGS

The above and other objects, features and advantages of the present invention will be more clearly understood from the following detailed description of the preferred embodiments of the invention taken in conjunction with the accompanying drawings, in which.

DETAILED DESCRIPTION OF THE PREFERRED EMBODIMENTS

Figure 1:
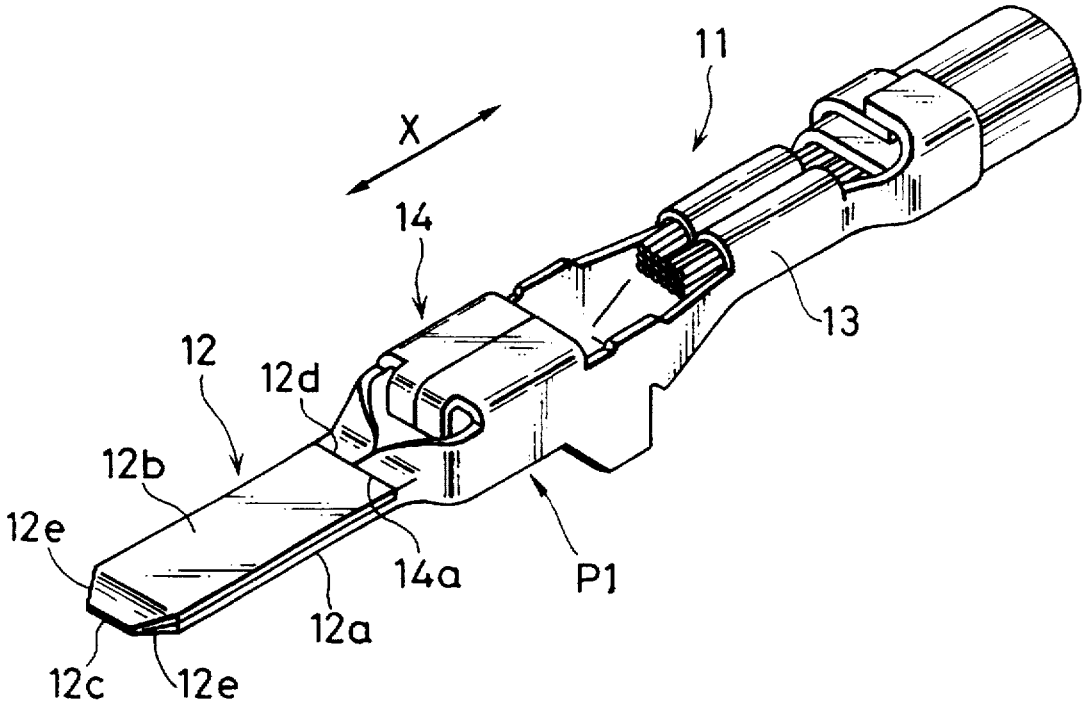
FIG. 1 is a perspective view of a metallic male terminal according to an embodiment of the present invention.

There will be detailed below the preferred embodiments of the present invention with reference to FIGS. 1 to 5. Like members are designated by like reference characters for a brevity of description.

FIG. 1 shows a metallic male terminal 11 according to a first embodiment of the invention.

The metallic male terminal 11 comprises a single shaped plate member P1, as it is pressed into a commercially available terminal configuration that includes: at a front end thereof a mating contact portion 12 formed by folding a front part of the plate member P1 into a flat tongue-like configuration matable with an unshown metallic female terminal; at a rear end thereof a connecting portion 13 deformable to clamp a stripped end of an electrical wiring as well as to hold an insulated part of the wiring, as shown in the figure; and in a middle therebetween a box-like body 14 configured for a safe accommodation of the stripped wiring end as well as for an increased rigidity of the terminal 11.

Figure 2:
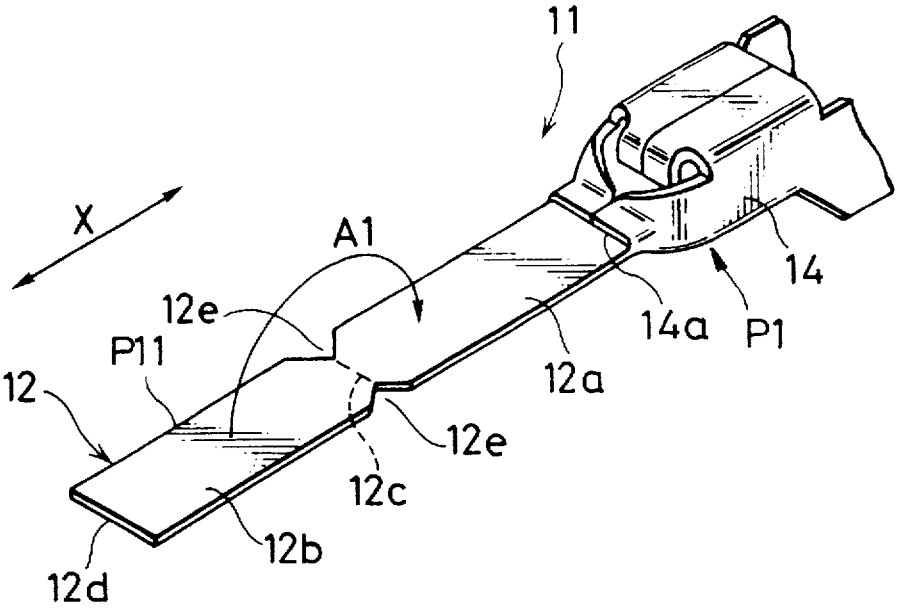
FIG. 2 is an exploded view of the male terminal of FIG. 1.

FIG. 2 shows the male terminal 11, as the mating contact portion 12 is exploded into an original form of the front part of the shaped plate member P1.

The front part of the plate member P1 comprises a strip plate P11 composed of a rear base strip 12*a* projecting from the box-like body 14 and a front foldable strip 12*b* as a front extension of the rear strip 12*a*, with a boundary therebetween width-reduced by giving V-shaped cuts 12*e* to provide a bending part 12*c*. The strip plate P11 has a total length equivalent to a sum of lengths of the strips 12*a* and 12*b*.

The mating contact portion 12 is formed into the tongue-like configuration by folding the total length of the strip plate P11 in two along the width-reduced boundary (12*c*) as a fold, in a bending manner in which the plate P11 is bent to be doubled in a longitudinal direction X of the terminal 11 so that the front strip 12*b* swings along an imaginary arrow Al to be laid over to an upside of the rear strip 12*a*.

Accordingly, as shown in FIG. 1, the bending part 12*c* constitutes a tip of the mating contact portion 12, and a front edge 12*d* of the front strip 12*b* abuts on a front edge 14*a* of the box-like body 14. The V-shaped cuts 12*e* will be chamfered.

According to the first embodiment, a mating contact portion 12 of a metallic male terminal 11 comprises a strip plate P11 composed of a base strip 12*a* and a foldable strip 12*b*, as the plate P11 is folded in a longitudinal direction X of the terminal 11 along a bending part 12*c* disposed at a tip of the mating contact portion 12, permitting the tip to be a fold 12*c* with a round outside free of burrs or edges.

Therefore, in a setting to a housing of an unshown connector, the mating contact portion 12 is insertable into a male terminal accommodation chamber of the housing, without giving flaws or injuries to an inside of the chamber.

Moreover, in a coupling of the connector, the tip 12*c* of the mating contact portion 12 is insertable through a male contact insertion hole of a counter housing of the connector from an engaging position to a mating position, without an undue binding by a tapered guiding surface of the insertion hole.

Figure 3:
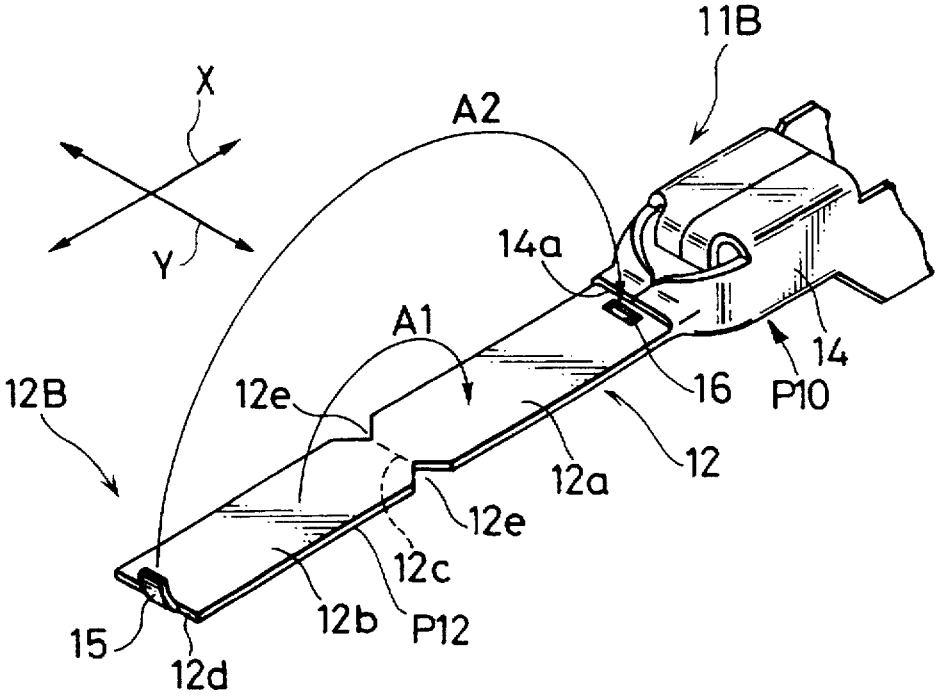
FIG. 3 is an exploded view of a metallic male terminal according to a modification of the embodiment of FIG. 1.

FIG. 3 shows an essential part of a metallic male terminal 11B according to a modification of the first embodiment, as a mating contact portion 12B of the male terminal 11B is exploded into an original form of a strip plate P12 in a plate member P10 that is deformable into a configuration of the terminal 11B.

The modification 11B is different from the first embodiment 11 in that a rear base strip 12*a* has an engagement hole or slot 16 formed in a rear-most part thereof and a front foldable strip 12*b* has on a front edge 12*d* thereof an upward projection 15 that moves along an imaginary arrow A2 and engages into the slot 16 when the front strip 12*b* is folded onto the rear strip 12*a*.

In the modification 11B, the projection 15 and the slot 16 cooperate with each other to serve as an engagement means for effecting an intra-engagement in the mating contact portion 12B to prevent the front strip 12*b* from slipping in a crossing direction to a longitudinal direction X of the male terminal 11B, i.e. from a slippage in a transverse direction Y of the terminal 11B.

Figure 4:
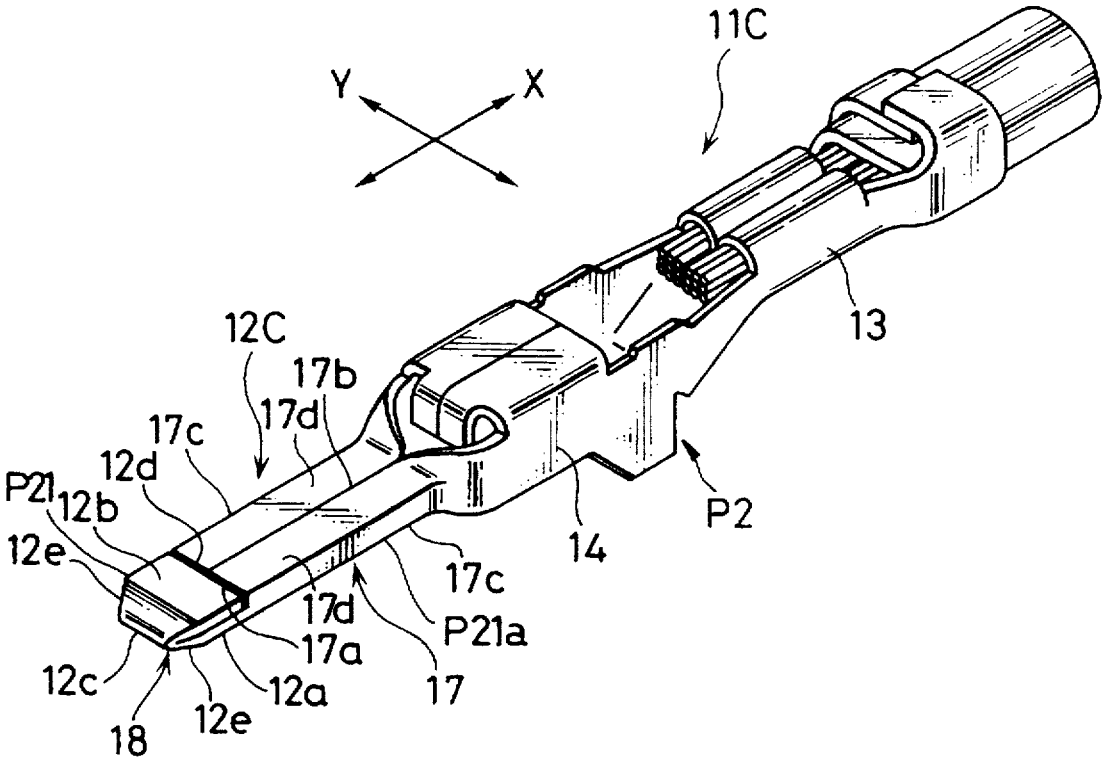
FIG. 4 is a perspective view of a metallic male terminal according to another embodiment of the invention.

FIG. 4 shows a metallic male terminal 11C according to a second embodiment of the invention, as it is configured from a shaped plate member P2 and put to a practical application.

The plate member P2 includes in an original form thereof a winged strip plate P21 comprising a relatively short front foldable strip 12*b* and a relatively long winged rear strip P21*a*, with a boundary therebetween width-reduced by giving V-shaped cuts 12*e* to provide a bending part 12*c*.

The rear strip P21*a* is composed of a base strip part 12*a* equivalent in width to and several times longer than the front strip 12*b*, and a pair of wing parts 17*d* formed either on both sides of the base strip part 12*a*.

Each wing part 17*d* is foldable onto the base strip part 12*a* along a bending part 17*c* therebetween, and has a width equivalent to half a width of the strip part 12*a* and a length equivalent to a length of the strip part 12*a* minus a length of the front strip 12*b*.

In the metallic male terminal 11C, a rigid mating contact portion 12C is constituted with a first contact part 18 disposed at a tip end thereof and a second contact part 17 disposed at a base end thereof.

The first contact part 18 is formed by folding the front strip 12*b* of the strip plate P21 along the bending part 12*c* in a longitudinal direction X of the male terminal 11C onto the base strip part 12*a* of the rear strip P21*a*. The second contact part 17 is formed by folding the wing parts 17*d* of the rear strip P21*a* along the bending parts 17*c* in their inward senses in a transverse direction Y of the terminal 11C.

As a result, a front edge 12*d* (of the front strip 12*b*) of the first contact part 18 abuts on a front end face 17*a* (of each wing part 17*d*) of the second contact part 17. In the second contact part 17, a pair of transversely opposing sides of the strip plate P21*a* (i.e. outer sides of the wing parts 17*d*) abut on each other in a transversely central region of the mating contact portion 12C, where an abutment 17*b* therebetween longitudinally extends, while the bending parts 17*c* are located as folds either on both transversely opposite sides of the contact portion 12C. The second contact part 17 is a few times longer than the first contact part 18.

Therefore, according to the second embodiment, a metallic male terminal 11C has a mating contact portion 12C free of burrs or edges on a tip 12*c* thereof, permitting similar effects to the first embodiment to be achieved.

Further, in the second embodiment, the mating contact portion 12C includes a second contact part 17 formed to be longer than a first contact part 18, by transversely folding a strip plate P21 so that the second contact part 17 has a pair of folds 17*c* located either on both transverse sides thereof, permitting the mating contact portion 12C to have an increased buckling strength in a longitudinal direction and to be hardly broken.

Figure 5:
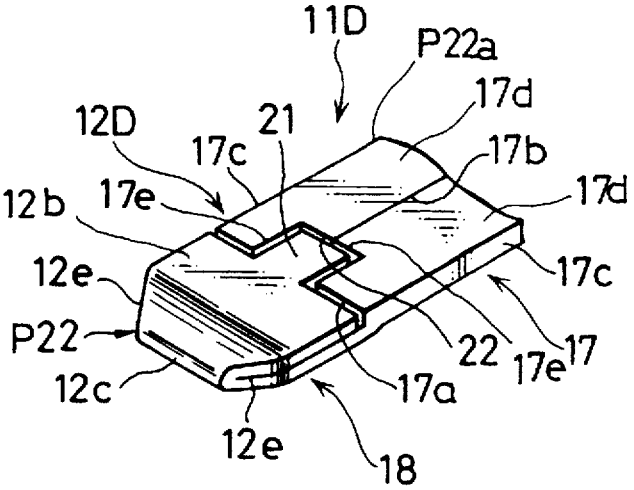
FIG. 5 is a perspective view of an essential part of a metallic male terminal according to a modification of the embodiment of FIG. 4.

FIG. 5 shows an essential part of a mating contact portion 12D of a metallic male terminal 11D according to a modification of the second embodiment, as it is configured by folding a strip plate P22.

This modification is different from the second embodiment in that the strip plate P22 has in a rear strip P22*a* thereof a pair of steps 17*e* cut either in outer front corners of both wing parts 17*d*, and in a front strip 12*b* thereof a frontward projection 21 formed on a middle part of a front edge of the strip 12*b*.

As the strip plate P22 is folded to form the mating contact portion 12D composed of a first contact part 18 in which the front strip 12*b* is longitudinally rearwardly folded and a second contact part 17 in which the wing parts 17*d* are transversely inwardly folded, the pair of steps 17*e* cooperate with each other to define an engagement recess 22 provided in a front edge of the second contact part 17 and the projection 21 fits in the recess 22.

In other words, the projection 21 and the recess 22 cooperatively constitute an engagement means for effecting an inter-engagement between the first and second contact parts 17, 18 to prevent the front strip 12*b* from slipping in a crossing direction Y to a longitudinal direction X of the terminal 11D.

It will be understood that such a transverse slippage of a folded front strip 12*b* in the second embodiment may favorably be prevented by cooperation between an engagement projection (similar to the projection 15, FIG. 3) formed on a front edge of the front strip 12*b* and an engagement slot (similar to the slot 16, FIG. 3) formed in a first or second contact part.

Although the preferred embodiments of the present invention have been disclosed for an illustrative purpose, those skilled in the art will appreciate that various modifications, additions and substitutions are possible, without departing from the scope and spirit of the invention as disclosed in the appended claims.

What is claimed is:

1. A metallic male terminal comprising:

a plate member folded to define a connecting portion and a mating contact portion;

the connecting portion being capable of connection to an electrical wire and having a transversely folded part abutting the mating contact portion, the transversely folded part being formed by folding the plate member in a transverse direction of the metallic terminal so that transversely opposite sides of the plate member abut each other in a transversely central region of the metallic male terminal;

the mating contact portion being integral with the connecting portion and formed by a folded plate member folded in a longitudinal direction of the metallic male terminal to define a tongue-like configuration capable of coupling a metallic female terminal.

2. The metallic male terminal according to claim 1, wherein the mating contact portion define the whole of the tongue-like configuration.

3. The metallic male terminal according to claim 2, wherein the mating contact portion has an engagement means for effecting an intra-engagement in the folded plate member to prevent the folded plate member from slipping in a direction transverse to the longitudinal direction of the metallic male terminal.

* * * * *